United States Patent [19]

Schmidt

[11] 4,003,163

[45] Jan. 18, 1977

[54] DOOR CONSTRUCTION

[76] Inventor: Gerhard R. Schmidt, Nierfeldstr. 2, 5804 Herdecke (Ruhr), Germany

[22] Filed: May 27, 1975

[21] Appl. No.: 581,282

[30] Foreign Application Priority Data

May 29, 1974 Germany ..... 2426290

[52] U.S. Cl. ..... 49/503; 49/382

[51] Int. Cl.[2] ..... E06B 3/70

[58] Field of Search ..... 49/501, 503, 382

[56] References Cited

UNITED STATES PATENTS

| | | | |
|---|---|---|---|
| 3,274,734 | 9/1966 | Davis | 49/503 |
| 3,287,855 | 11/1966 | Hallonquist et al. | 49/503 |
| 3,878,647 | 4/1975 | Burgers | 49/503 X |

FOREIGN PATENTS OR APPLICATIONS

| | | | |
|---|---|---|---|
| 1,521,420 | 3/1968 | France | 49/501 |

*Primary Examiner*—Kenneth Downey
*Attorney, Agent, or Firm*—Learman & McCulloch

[57] ABSTRACT

A door construction comprising a core member formed of chip plate having cavities therein at locations corresponding to the positions to be occupied by fittings such as hinge plates, locks, and the like. Each cavity is filled by a hardwood plug into which hardware such as screws may be secured. The faces and edges of the core preferably are covered by veneer, either of wood, asbestos, plastic or metal.

8 Claims, 5 Drawing Figures

DOOR CONSTRUCTION

The invention relates to a door, more particularly for interior installation.

The known interior doors (plywood doors according to DIN 68706) consist of a surrounding frame, an insert and the cover plates. The frame consists of solid wood strips and its purpose is to give the entire door the necessary stability and to accommodate the hinge plates or the like and the lock. It surrounds the insert, which consists of solid wood, wood materials or other suitable materials and together with the frame serves to space the two cover plates and to stiffen the door. The cover plate is a plate of wood materials or the like.

As apparent from the above outline of the door construction, this conventional door structure requires a complicated and time-consuming production (for example the pressing of the cover plates alone requires a pressing time of several minutes).

The invention is therefore based on the problem of developing a door which on the one hand has the necessary properties, such as stability, adequate weight, sound and fire resistance and the like, but which on the other hand is distinguished by a substantially simplified and cost-reducing production.

This problem is solved according to the invention in that the door comprises as core a chip plate which is reinforced preferably at the points intended to receive the hinge plates and/or the lock by hardwood plugs.

Thus, in the door according to the invention the hitherto usual three structural components (frame, insert and cover plates) are replaced by a single component, i.e., a chip plate. This considerably reduces the number of individual components and greatly reduces the necessary operations, giving a substantial simplification and cost reduction in the production.

The necessary strength and stability, preferably at the points intended to receive the hinge plates and the locks, is achieved in the door according to the invention by hardwood plugs subsequently inserted into the chip plate. These plugs may also be inserted at any other point. Apart from providing a firm anchoring for fittings, small iron work, screws and the like, the hardwood plugs also fulfill the important function of considerably reinforcing the entire rabbet edge or recess. In this manner, the danger of breakage under high stress by slamming or in the lower edge regions due to inclined fitting is avoided.

According to a preferable further development of the invention a veneer is applied directly to the chip plate. Compared with the application of a cover plate (having a thickness of several mm) a veneer may be pressed on in a substantially shorter time (for example for a veneer thickness of about 0.6 mm a pressing time of only about 30 seconds is necessary). As tests have shown, this simple veneering of the chip plate provides a further substantial stabilization of the door without having to use inter alia the framing wood hitherto necessary in wood doors. This veneer may consist of wood, plastic, metal or any other suitable material.

According to a further expedient development of the invention, the rabbet edges of the chip plate are provided with a veneer which may consist of plastic, wood or similar materials. Such a veneer may advantageously be applied in single strips or alternatively seamless in one piece in a continuous process.

By previously spraying on glue or by previous coating of the veneer with melt adhesives or the like not only a homogeneous bonding between veneer and chip plate edge or rabbet edge is achieved but additionally a hardening of the edge region of the chip plate by the adhesive composition penetrating into the open pores and adhering the wood particles together. This method may be applied both to blunt, i.e., smooth, or rabbeted and profiled edges. This socalled edge hardening contributes to making the hitherto necessary crossbar superfluous.

Preferably, at least two wood plugs are provided in each case on the right edge and on the left edge of the door. The plug spacing is made to correspond to a respective DIN provision or the requirements of the edge protection. The plugs may have a length of about 60 mm and a diameter of about 20 mm (of course, plugs having dimensions other than these may also be used within the scope of the invention).

Depending on the forces occuring, the plugs may be let at different angles into the chip plate to conduct the forces occurring in optimum manner into the interior of the chip plate.

An embodiment of the invention is illustrated in the drawings, wherein.

Figure 1:
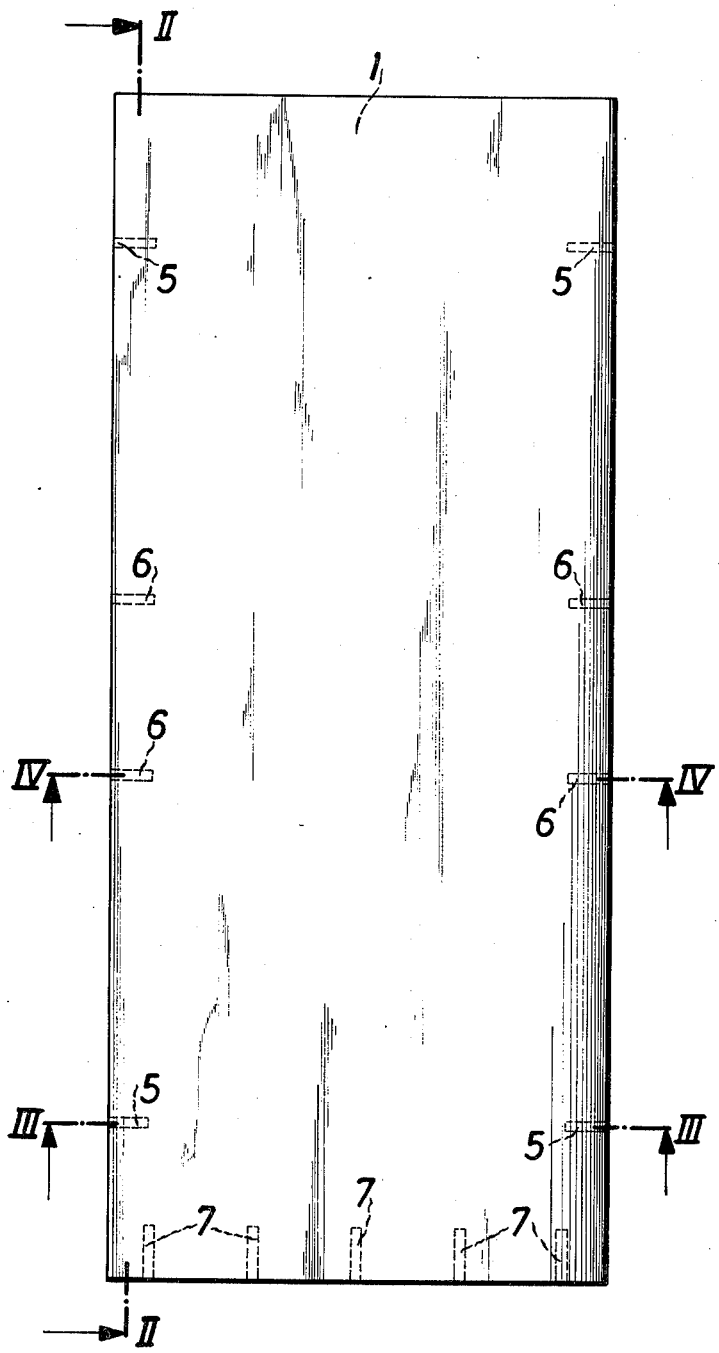
FIG. 1 is an elevational view of a door according to the invention.
Figure 2:
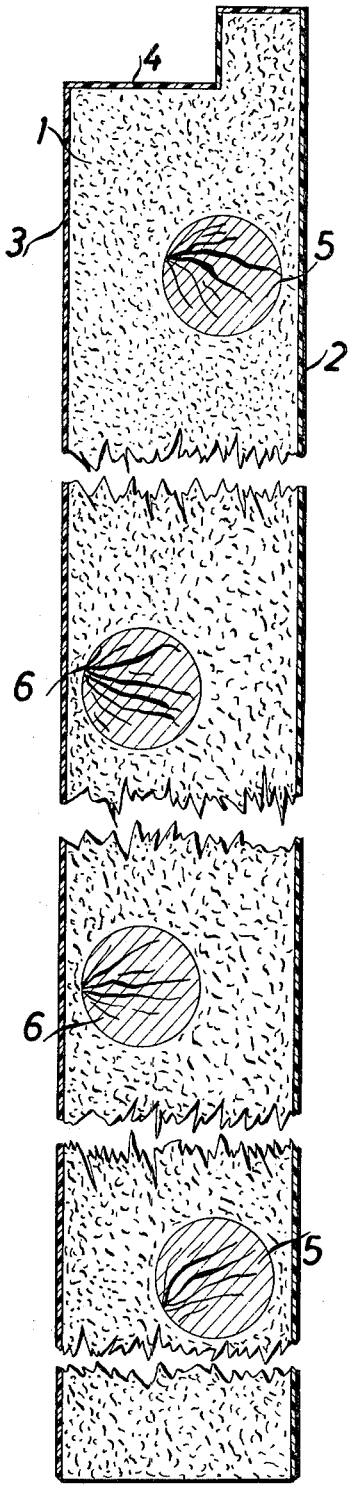
FIG. 2 is a section along the line II—II of FIG. 1.
Figure 3:
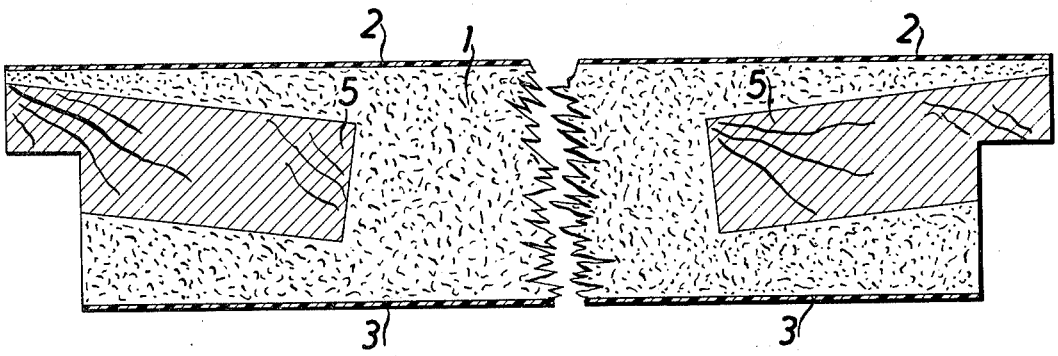
FIGS. 3 and 4 are sections along the lines III—III and IV—IV respectively of FIG. 1.
Figure 4:
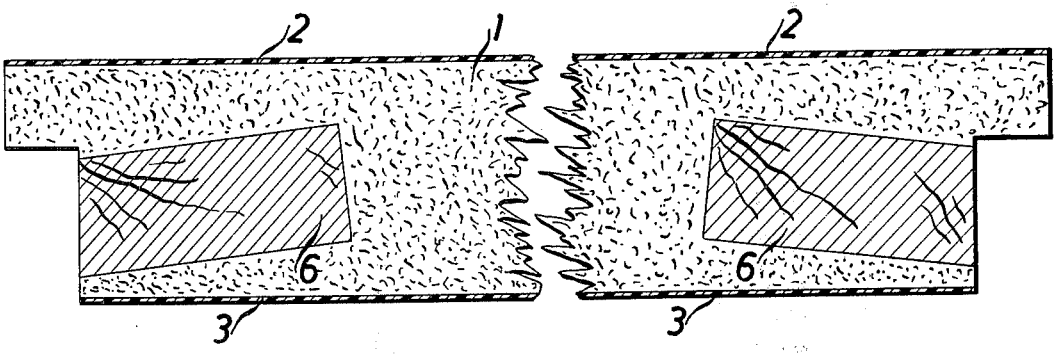
Figure 5:
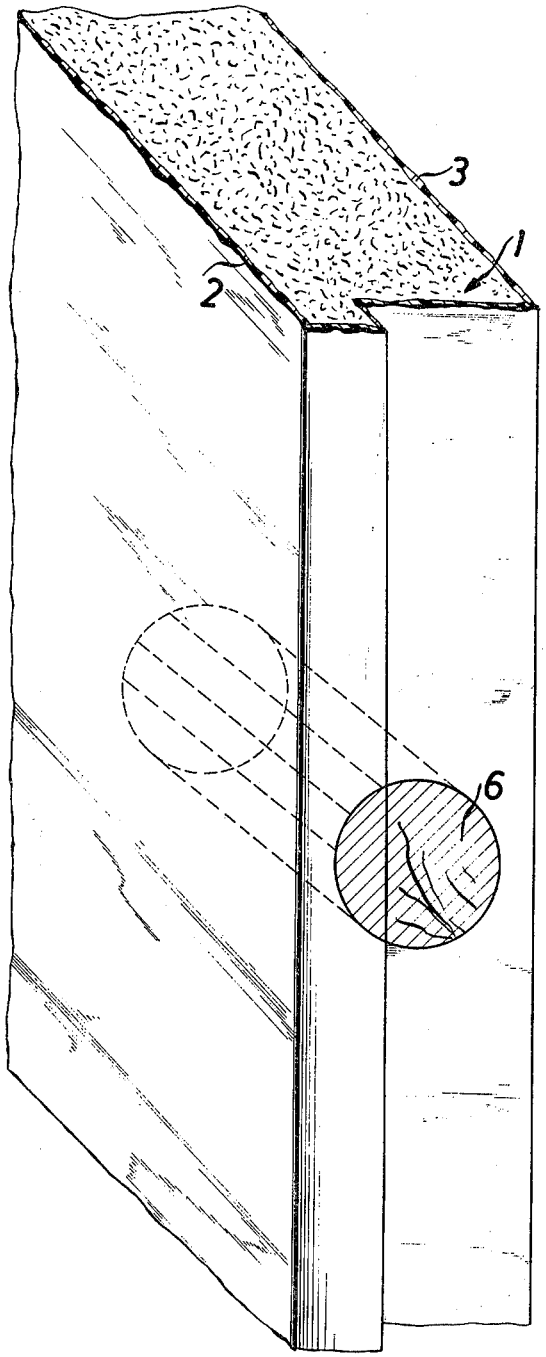
FIG. 5 is a fragmentary perspective view of a portion of the door according to the invention.

The door illustrated has as its core a chip plate 1, which is provided at the two wide sides with a veneer 2, 3 and in the region of the rabbet recess or rabbet edge with a veneer 4.

At least two wood plugs 5 and 6 respectively are provided at the right and left edges of the door at least at the points intended to receive the hinge plates and the like and in the lock area. A further insertion of plugs — not illustrated — is convenient also in the lower edge region of the doors at the extreme right and left lower ends to further stabilize this edge region. These hardwood plugs additionally reinforce and stabilize the entire rabbet edge.

Such a door is manufactured completely automatically in the following manner:

a. Holes serving to receive the hardwood plugs 5, 6 are bored in the chip plate 1;
b. hardwood plugs 5, 6 are then driven in;
c. after this, the blank runs through a glue applying machine;
d. the upper and lower veneers 2 and 3 are applied;
e. the door blank is pressed;
f. the doors are then rabbeted and cut exactly to length and width;
g. the veneer is then applied in the upper transverse rabbet;
h. the veneer is then applied to the side rabbets;
i. the door is then passed through a grinding machine;
j. this is followed by passage through a varnishing apparatus;
k. this is followed by passage through a drying channel;
l. thereafter the holes for receiving the hinge plates or the like and the lock fittings are drilled in the hardwood plugs 5, 6;
m. the elongated bores 7 are then made at the lower edge to mount a protective rail;

n. the door is then packaged, simultaneously fitting the lower protective rail.

The door according to the invention may be used not only as an interior door but also as an outer door. In the latter case, preferably a covering layer, for example of metal, is provided which has adequate resistance to weather. For a fire-proof door or the like asbestos or cement asbestos may also be used.

It has been found essential for the solution according to the invention to select a chip plate whose weight or density is substantially less than that of hitherto usual chip plates (above 650 kg/m$^3$). According to the invention, the weight of the chip plate used as core for the door is between 250 and 500 kg/m$^3$, preferably between 400 and 450 kg/m$^3$. A door blank may then for example be given a weight of about 30 kg; on the one hand, it permits easy manipulation of the door and on the other hand the compacting of the chip plate with a specific weight between 400 and 450 kg/m$^3$ in conjunction with the hardwood plugs provided for reinforcement according to the invention guarantees the necessary stability and strength. Chip plates having a comparably low specific weight of the aforementioned type may for example be made in the form of flax chip plates; however, such low weights may also be achieved using wood chip plates or particle boards.

A convenient further development of the door according to the invention resides in providing elongated bores 7 at the lower edge. In the initial state of the door, when it is not cut to size, the length of these bores is made of such magnitude that after cutting the door to its particular height at the point of installation an adequate length remains to accommodate plugs which are mounted on a protective rail. This protection rail protects the cut edge of the door in particular from the penetration of moisture. At the same time, the plugs provided on the protective rail and engaging in the bores of the chip plate reinforce the latter in the region of its lower edge and thus contribute to obtaining the necessary rigidity.

It is finally further mentioned that the door according to the invention is distinguished by good sound and fire-resistant properties.

What is claimed is:

1. A door construction adapted to have fittings such as hinge plates, a lock, and the like mounted thereon, said construction comprising a core member formed of chip plate, said core member having cylindrical bores extending inwardly from the edge surfaces thereof at positions corresponding to those at which said fittings are to be mounted, a cylindrical hardwood plug seated in each of said bores, said core member having at least one rabbeted edge, and an outer layer of veneer adhesively bonded directly to the surfaces of said core member and to said rabbeted edge.

2. A construction according to claim 1 including asbestos-like material applied to said core member.

3. A construction according to claim 1 wherein said veneer is seamless and deformable.

4. A construction according to claim 1 wherein said core has pores therein, and wherein said pores are closed by the application to said core member of an adhesive.

5. A construction according to claim 1 wherein said cylindrical plugs have a length of about 60 mm. and a diameter of about 20 mm.

6. A construction according to claim 1 wherein said chip plate has a density of between 250 and 500 kg/m$^3$.

7. A construction according to claim 6 wherein the density of said chip plate is between 400 and 450 kg/m$^3$.

8. A construction according to claim 2 wherein one edge of said core is provided with elongate blind bores fitted with additional plugs, the length of said additional plugs being less than the depth of said blind bores.

* * * * *

UNITED STATES PATENT AND TRADEMARK OFFICE

CERTIFICATE OF CORRECTION

PATENT NO. : 4,003,163
DATED : January 18, 1977
INVENTOR(S) : Gerhard R. Schmidt It is certified that error appears in the above-identified patent and that said Letters Patent are hereby corrected as shown below:

Column 4, line 33, change "2" to -- 1 -.

Signed and Sealed this

Seventh Day of June 1977

[SEAL]

*Attest:*

RUTH C. MASON
*Attesting Officer*

C. MARSHALL DANN
*Commissioner of Patents and Trademarks*